United States Patent [19]

Marsden

[11] Patent Number: 5,038,682

[45] Date of Patent: Aug. 13, 1991

[54] ELECTRONIC DEVICE

[75] Inventor: Mark Marsden, Johannesburg, South Africa

[73] Assignee: Plessey South Africa Limited, Cape Province, South Africa

[21] Appl. No.: 385,227

[22] Filed: Jul. 25, 1989

[30] Foreign Application Priority Data

Jul. 26, 1988 [ZA] South Africa ..... 88/5447

[51] Int. Cl.[5] ..... F42C 11/06; F42C 11/04

[52] U.S. Cl. ..... 102/220; 102/217

[58] Field of Search ..... 102/200, 206, 217, 218, 102/219, 220

[56] References Cited

U.S. PATENT DOCUMENTS

| | | | |
|---|---|---|---|
| 3,170,399 | 2/1965 | Hinman, Jr. | 102/219 |
| 3,834,310 | 9/1974 | Ueda et al. | 102/220 |
| 4,536,693 | 8/1985 | Marek | 102/218 |
| 4,615,268 | 10/1986 | Nakano et al. | 102/217 |

FOREIGN PATENT DOCUMENTS

| | | | |
|---|---|---|---|
| 137800 | 8/1984 | Japan | 102/206 |

*Primary Examiner*—Deborah L. Kyle
*Assistant Examiner*—Stephen Johnson
*Attorney, Agent, or Firm*—Merchant, Gould, Smith, Edell, Welter & Schmidt

[57] ABSTRACT

A remote controllable electronic detonator and a method of detonating an explosive charge are disclosed and claimed. The detonator comprises an antenna 16, a RF receiver 15, an energy storage capacitor 17, a switch 18, a delay time circuit 21 and a fuse 19. The method comprises the steps of transmitting to the detonator, by means of transmitter 11, a wave comprising a carrier amplitude modulated by a low frequency modulating signal, receiving the wave and utilizing energy in the wave to charge capacitor 17, enabling switch 18 by increasing the frequency of the modulating signal and communicating, by means of the wave, a fire command signal to the detonator. After a predetermined time delay, switch 18 connects capacitor 17 to fuse 19 thereby to energize the fuse.

20 Claims, 2 Drawing Sheets

ELECTRONIC DEVICE

BACKGROUND OF THE INVENTION

1. Field of the Invention

This invention relates to a detonator for use in setting off an explosive charge, and to a method of setting off an explosive charge.

2. Background Information

Detonators are used extensively in mining and quarrying. In use, a detonator is arranged in close association with a primer. The detonator has a fuse which detonates the primer, the primer in turn causes the charge to explode. It is often desirable to set off a series of explosive charges sequentially, with accurate, split-second timing between explosions. An arrangement for effecting such sequential detonation is referred to as a sequential detonics train.

Existing detonator utilise either a cord which is ignited and burns, or a fuse wire which is ruptured by passing an electrical current therethrough. In the cord type of detonator, timing is determined by the length of the cord and the speed at which it burns. They have the disadvantage that timing can often not be controlled accurately enough and that a burning cord is not acceptable in certain environments such as, for example, in coal mines where there is the risk of gas explosions. In the fuse wire type of detonators, timing is usually provided by electronic means. A drawback of some known fuse wire type detonator is that they require long lengths of insulated, relatively heavy gauge copper wire running from the source of current that is used to rupture them. The wire is costly and the copper as well as the insulation ends up as impurities in the ore that is being mined, and as such is unwanted.

SUMMARY OF THE INVENTION

It is an object of the present invention to provide an alternative method of detonating an explosive charge as well as a primer for use in the said method with which the applicant believes the aforementioned disadvantage will at least be alleviated.

According to the invention there is provided a method of detonating an explosive charge at a blast site from a remote control site by means of an electronic detonator located adjacent the charge at the blast site, the detonator comprising fuse means connectable to energy storage means by switch means, the method comprising the steps of:

charging the storage means by transmitting from the control site an electromagnetic wave comprising at least two sinusoidal components, receiving the wave at the blast site and storing energy in the wave in the storage means;

enabling the switch means by changing the frequency of one of the components so that the switch means is actuable from the remote site to connect the storage means to the fuse means; and actuating the switch means to connect the charged storage means to the fuse means by communicating by means of the wave a fire command signal to the detonator thereby to energize the fuse means to cause the charge to explode.

The wave preferably comprises a radio frequency carrier amplitude modulated by a modulating signal.

The storage means may be charged by initially tuning a resonant circuit connected to the storage means to a first carrier frequency, utilising the wave with the carrier changing at the first frequency to charge the storage means to a level where it is still insufficiently charged to energize the fuse means, utilizing frequency pulling in the resonant circuit to change the tuning frequency; changing the carrier frequency accordingly; and utilizing the wave with the carrier changing at the changed frequency to charge the storage means to a level where it is sufficiently charged to energize the fuse means.

While charging the storage means, the carrier may be modulated by a relatively low frequency modulating signal. The enabling means may be armed by increasing the frequency of the modulating signal to a relatively higher frequency. The relatively higher frequency modulating signal is utilised to arm enabling means in the detonator to change from a normally unarmed state to an armed state enabling the switch to be actuated.

The method may also comprise the step of timing out a predetermined delay time after reception of the fire command signal at the blast site and before the storage means is connected to the fuse means. The delay time may be determined by a RC time-constant in the detonator.

In the preferred form of the method the fire command signal is communicated by terminating transmission of the wave.

According to another aspect of the invention a remote controllable electronic detonator for an explosive charge comprises:

means for the wireless reception of an electromagnetic wave;

energy storage means connected to the receiving means, the storage means being chargeable by energy in the wave;

fuse means;

remote controllable switch means which, when enabled, is actuable by a fire command signal carried by the wave to connect the energy storage means to the fuse means; and frequency dependent means connected to the switch means for enabling the switch means;

the enabling means normally being in an unarmed state wherein the switch is not actuable by the fire command signal and being adapted to be converted, by changing the frequency of a component of the wave, to an armed state wherein the switch means is actuable by the fire command signal to connect the storage means to the fuse means to energize the fuse and to cause the charge to explode.

The receiving means may comprise a radio frequency resonant circuit tunable to the frequency of a radio frequency carrier of the wave which is amplitude modulated by a modulating signal.

The detonator preferably also comprises delay time means for effecting a predetermined delay time after reception by the detonator of the said fire command signal and before the switch means connects the storage means to the fuse means.

The energy storage means may comprise a first capacitor arranged to be charged via the resonant circuit. There may be a first resistive decay path for the capacitor, so that, when the wave is terminated, any charge on the capacitor can decay via said path. The first capacitor and first resistive decay path constitutes first time constant means in the detonator.

The time delay means may comprise a second capacitor arranged to be charged via the resonant circuit and a second resistive decay path connected to the second capacitor to provide second time constant means, the time constant provided by the first time constant means being longer than the time constant provided by the second time constant means.

The enabling means is preferably armed by changing the frequency of the modulating signal.

The enabling means is arranged in the primer such that when it is in the unarmed state it inhibits decay of charge on the second capacitor and when it is in the armed state it allows decay of the charge on the second capacitor thereby to actuate the switch means.

In the preferred embodiment of the detonator, the second capacitor is arranged such as to be charged to a voltage opposite to that on the first capacitor, the second resistive path is arranged such that when the enabling means is armed the charge on the second capacitor can decay towards the voltage on the first capacitor, and the switch means is arranged such that it connects the first capacitor to the fuse means when the decaying voltage on the second capacitor has reached a predetermined value.

Also in the preferred embodiment of the detonator the enabling means comprises a thyristor switch having a control gate, the gate being connected to a third capacitor chargeable by the wave via a charge pump connected between the resonant circuit and the third capacitor, the enabling means being in the unarmed state while the voltage on the third capacitor is below a predetermined triggering voltage value for the thyristor switch, the values of the third capacitor and the third resistor being such that while the modulating signal has a frequency below a predetermined frequency the charge on the third capacitor decays at a rate faster than the rate at which charge is fed to the capacitor and when the frequency of the modulating signal is increased to the predetermined frequency value, charge builds up on the third capacitor until the voltage on the third capacitor exceeds the said triggering value thereby to trigger the thyristor switch and to arm the enabling means.

The resonant circuit may comprise at least one diode having a varicap effect on the resonant circuit thereby to vary the resonance frequency of the circuit as the first capacitor charges up.

BRIEF DESCRIPTION OF THE DRAWINGS

The invention will now further be described, by way of example only, with reference to the accompanying diagrams wherein.

DETAILED DESCRIPTION OF THE PREFERRED EMBODIMENT

Figure 1:
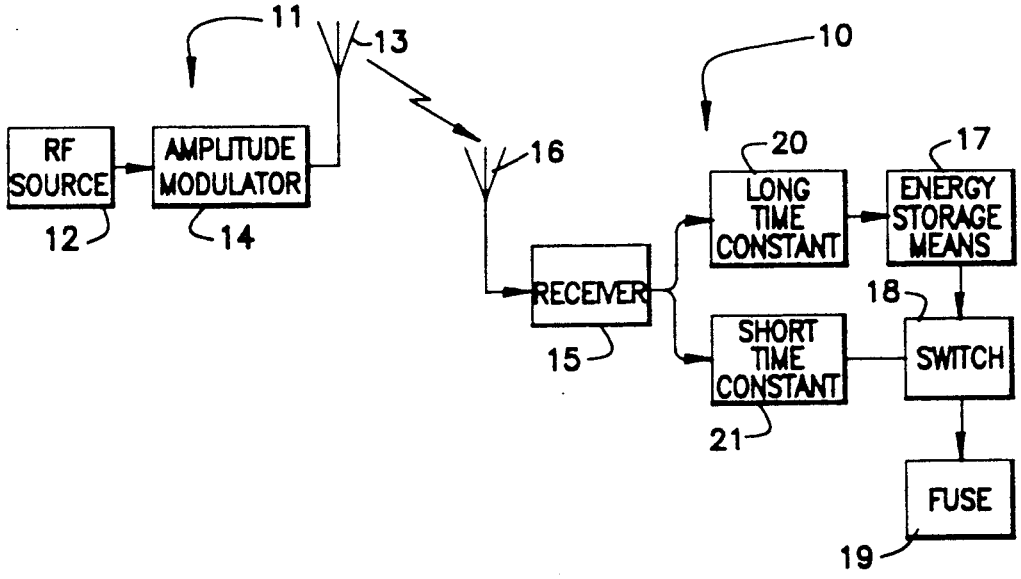
FIG. 1 is a simplified block diagram of a detonator in accordance with the invention, and a transmitter for use with the detonator.

Referring first to FIG. 1, reference numeral 10 generally indicates a detonator, and reference numeral 11 a transmitter for use with the detonator. The transmitter 11 comprises a high-power RF source 12, an antenna 13, and an amplitude modulator 14 for modulating a carrier with a modulating signal. The detonator 10 comprises a radio receiver 15, an antenna 16, energy storage means 17, a switch 18, a fuse 19, long time constant means 20, and short time constant means 21.

In use, the detonator 10 is installed by affixing it to a primer (not shown) which is arranged to set off a main explosive charge (also not shown) and by deploying the antenna 16. The antenna 16 is preferably of the foldable or collapsible type, which has to be unfolded before it can effectively receive transmissions from the transmitter 11. Once the detonator 10 has been installed and it is desired to detonate the main explosive charge, the transmitter 11 is switched on to transmit the amplitude modulated wave via the antenna 13. The antenna 16 receives the wave and utilizes energy in the wave to charge up the energy storage means 17 via long time constant means 20. The switch 18 is normally open.

When the transmitter 11 is switched off, the short time constant means 21 causes the switch 18 to close a predetermined delay time after the transmitter has been switched off. Closing of the switch 18 causes the energy storage means 17 to discharge through the fuse 19, thereby rupturing the fuse. This in turn detonates the primer and causes the main explosive charge to explode. By selecting a detonator 10 with a known delay time, the exact time of detonation in relation to the time of switching off the transmitter will be known. A number of primers, each selected to have a fractionally different delay time, and each responsive to transmissions from the same transmitter 11, can thus be used in a sequential detonics train.

The antenna 16 can be made of a conductive rubber O-ring (not shown) which, when not in use, folds down along the side of the detonator and is covered with a pressed metal cover (also not shown). The cover will protect and screen the detonator and antenna during storage and transportation. The cover can also be labelled clearly with the sequencing delay. If a loop antenna in the form of a folded-dipole (also not shown) is folded such that both halves lie side by side, any electromagnetic field picked up by the two halves of the antenna will cancel, and the arrangement is thus inherently self-screening. With the additional screening provided by the aforementioned metal cover, the detonator will be substantially immune to accidental firing.

Figure 2:
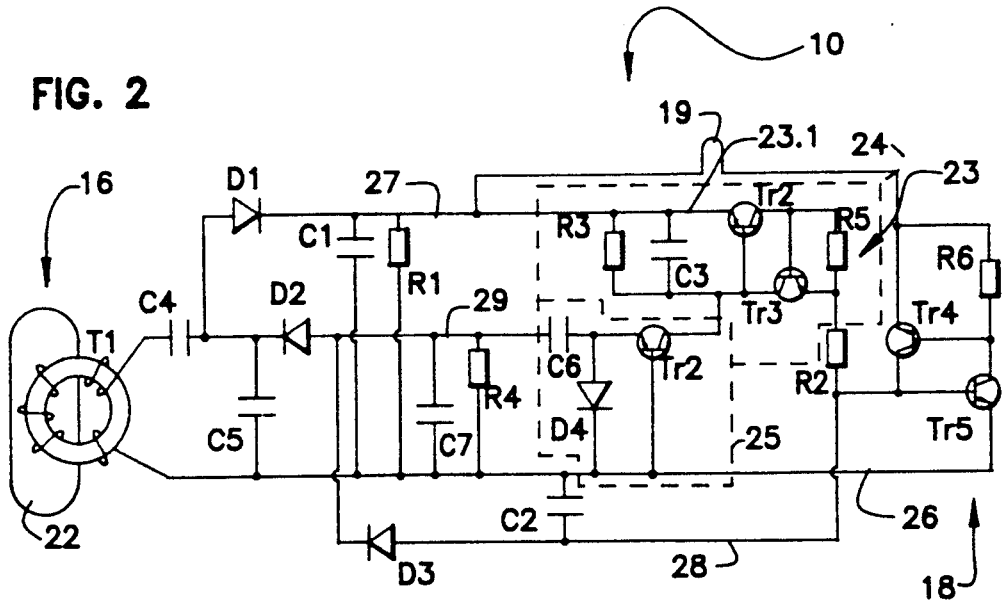
FIG. 2 is a detailed circuit diagram of the detonator.

The more detailed construction and operation of the detonator 10 will now be described with reference to FIG. 2. The antenna 16 is in the form of a loop antenna having a single turn of wire 22 passing through the centre of a high-Q torroidal core T1. A secondary winding on core T1 has several turns, thus providing a step-up transformer configuration. The secondary winding is resonated by a capacitor C5, via DC isolating capacitor C4. The energy storage means 17 of FIG. 1 is provided in the FIG. 2 circuit by a capacitor C1 which is connected via a diode D1 across C5. The long time constant means 20 of FIG. 1 is provided in the FIG. 2 circuit by a resistor R1 connected across C1. The short time constant means 21 of FIG. 1 is provided in the FIG. 2 circuit by a capacitor C2 which is connected via diodes D3 and D2 across C5, and a resistor R2 connecting C2 to C1 via a latching circuit 23. The switch 18 of FIG. 1 is provided in the FIG. 2 circuit by a transistor pair Tr4, Tr5, connected with a resistor R6 to function as a thyristor switch.

As will be described hereinafter, the thyristor switch 18 is switched on by switching off the transmitter 11. However, to prevent the switch 18 from switching on should the transmitter 11 accidentally be switched off or lose power, remote-controllable, frequency dependent switch enabling means 24 which will be described herebelow, is provided. The enabling means 24, is normally in an unarmed state and the switch 18 can only be switched on when the enabling means has been armed. The enabling means comprises the aforementioned latching circuit 23 and the parallel connection of a capacitor C3 and a resistor R3. The enabling means is connected to C5 by the parallel connection of a capacitor C7 and a resistor R4, connected across C5 via D2 and a transistor charge pump 25. The charge pump 25 comprises a capacitor C6, a diode D4 and a transistor Tr1. The latching circuit 23 comprises a transistor pair Tr2 and Tr3, connected with a resistor R5 to function as a thyristor switch. It has a control gate 23.1.

Operation of the FIG. 2 circuit is as follows:

Radio frequency energy received by the antenna 16 causes the resonant circuit including T1 and C5 to resonate and a radio frequency voltage to appear across C5. The power output of the transmitter 11, the turns ratio of T1, and the unloaded Q-factor of the resonant circuit should be such that a sufficiently high RF voltage can develop across C5. The RF voltage charges up C1, C3 and C7. The peak voltage on the capacitors in relation to the output power of the transmitter 11 can be increased by amplitude modulation of the transmitted RF power at a relatively low modulating frequency of, say, about 100 Hz.

Considering common rail 26 as an earth rail, charging of the capacitor C1 establishes a positive voltage on rail 27, charging of the capacitor C2 a negative voltage on rail 28, and charging of the capacitor C7 a positive voltage on rail 29.

The latching circuit 23 of switch enabling means 24 will normally be in a switched off or unarmed state, and the negative voltage on rail 28 will reverse bias Tr5. This will inhibit switching on of the switch 18. Furthermore, Tr5 is selected such that its emitter-base junction has a zenering effect on the voltage on rail 28, thus clamping the voltage on rail 28 to a predetermined maximum value which is independent of the RF power incident upon the antenna 16. As a result of the loading of this zenering effect on the resonant circuit, this will also effectively clamp the maximum voltage on rail 27 to the same value.

Should the transmitter 12 be switched off or lose power with the latching circuit 23 in its normally switch off condition and the enabling means therefore in its unarmed state, C1 will discharge through R1. As soon as the voltage has dropped to a value below that which is required to rupture the fuse 19, the detonator can safely be handled.

To enable the switch 18 to be actuated to connect storage means C1 to fuse 19, the frequency of the modulating signal in transmitter 11 is increased to a relatively high frequency of, say, about 1000 Hz. The charge pump 25 has the effect of transferring a certain amount of charge from the rail 29 to C3 for each cycle of the amplitude modulation. Thus, the rate at which charge is transferred to C3 depends on the frequency of the amplitude modulation. C3 is in turn discharged by R3. When the frequency of the modulating signal is 100 Hz, the rate at which charge is transferred to C3 in relation to the rate at which C3 discharged via R3 is insufficient to raise the voltage across C3 and at gate 23.1 to above a latching circuit triggering voltage of 600 mV. When, however, the frequency of the modulating signal is 1000 Hz, the rate at which charge is transferred to C3 in relation to the rate at which C3 discharges via R3 is sufficient to cause the voltage across C3 and at gate 23.1 to rise above 600 mV. When the frequency of the modulating signal is changed from 100 Hz to 1000 Hz, the voltage across C3 does not, however, immediately rise to above 600 mV. A certain minimum number of cycles of the amplitude modulation will be required. When the voltage across C3 and at gate 23.1 has risen to 600 mV, the latching circuit 23 is switched on and the switch enabling means 24 consequently is armed. However, while RF power is still incident upon the antenna 16, C2 will remain charged, maintaining the reverse bias on Tr5. Thus, even with the enabling means 24 in the armed state the voltage on rail 28 is unable to switch on the switch 18.

Figure 3:
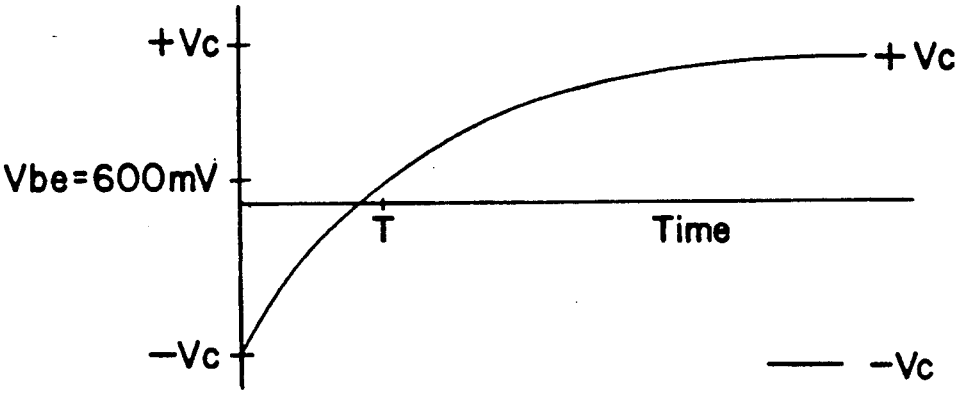
FIG. 3 is a graph of voltage against time on a time delay capacitor of the detonator.

When the RF power is switched off at the transmitter 11 while the enabling means 24 is in the armed state, C2 will rapidly discharge through R2 and the voltage on rail 28 rise towards the positive voltage on rail 27, at a time constant which is essentially determined by the values of C2 and R2. This is shown in the graph of FIG. 3, where $-Vc$ is the initial voltage on C2 and $+Vc$ is the voltage on C1. When, at time T, the voltage at the base of Tr5 has reached about $+600$ mV, the switch 18 is switched on, discharging C1 through the fuse 19. This ruptures the fuse and sets off the main explosive charge.

It has been found that the resonant frequency of the resonant circuit varies with the charge state of C1, C2 and C7. This is due to the varicap effect of the diodes D1, D2, and D3. This effect is also referred to as frequency pulling, and depends on the ratio of the varicap capacitance to the fixed capacitance of C5. Hewlett Packard HP 5082-2800 diodes, for example, provide a varicap capacitance which varies from 1.5 pF to 0.5 pF as the reverse bias is varied from 0 V to $-10$V. The effect of this is that the resonant frequency of the resonant circuit is lower with the capacitors in their discharged condition than it is when the capacitors are in their charged condition. This has enabled an additional safety feature to be incorporated in the system. By selecting the component values such that the frequency pulling effect is sufficiently prominent, C1 cannot be charged sufficiently to energize fuse 19 by a transmitted wave having a constant carrier frequency. Instead, to charge C1 sufficiently to energize fuse 19, it is necessary to increase the frequency of the carrier from a first lower value when the capacitors are in their discharged condition, to a higher value as the capacitors charge up. It is not necessary to sweep the frequency smoothly from the low to the high frequency. Instead, it can be stepped through a number of discrete frequencies from low to high.

A folded dipole receiver antenna with an impedance of 300 ohm, and a received power level of 10 mW is equivalent to generating 1.73 V across a 300 ohm load. This can then, by the turns ratio of T1, be stepped up by a factor of five to a voltage of 8.6 V RMS. This RMS voltage is equal to a peak to peak voltage of 24.5 V. If the signal is 100% amplitude modulated the maximum peak to peak voltage will be 49 V. These circuit conditions can be achieved using a transmitter power of 110 Watts and a carrier of 200 MHz, using small folded dipole antennas, and with the transmitter 11 and the primer 10 separated by 25 m.

These calculations are based on the formula for free space propagation loss. In a mine tunnel however the situation is more like a bounded waveguide with lossy walls. Depending on the surface absorption, roughness of the walls and shape of the tunnel, this will probably result in a greater received signal strength than the free space case since the energy is contained in a bounded volume and is not dissipated in all directions.

The secondary of the transformer has five turns and is realised as a close-wound coil of 1.2 mm wire (18 SWG) wound on a 5 mm mandrel, 5 mm long with inductance of 1.2 μH and a Q of 200. To resonate this at 200 MHz requires a capacitance of 6.5 pF which gives a varicap pulling effect, (2×0.5 to 1.5 pF), of 30%, implying a need for a frequency agile transmitter capable of tuning from 140 MHz to 200 MHz.

Figure 4:
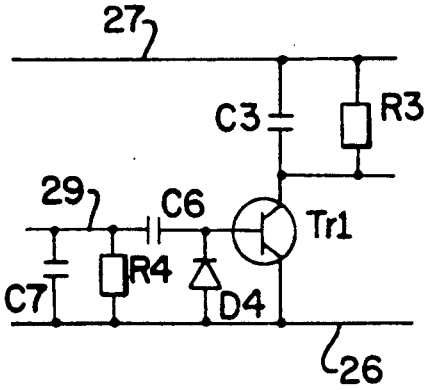
FIG. 4 shows a modification of the FIG. 2 circuit.

The modification illustrated in FIG. 4 consists of changing the connections of Tr1 so that it will act as an amplifier. The rate at which charge is transferred to C3 will now depend predominantly on the current gain of Tr1. This will improve the power budget of the detonator in that there is less loading of the tuned circuit by C7 as C6 and C7 can be made smaller and R4 thus greater.

It will be appreciated that there are many variations in detail possible on the detonator and the method according to the invention of detonating an explosive charge without departing from the scope and spirit of the appended claims.

We claim:

1. A method of detonating an explosive charge at a blast site from a remote control site by means of an electronic detonator located adjacent the charge at the blast site, the detonator comprising fuse means, energy storage means and switch means, wherein the switch means is connected to the fuse means and the energy storage means for selectively connecting the energy storage means to the fuse means, the method comprising the steps of:

charging the storage means by transmitting from the control site an electromagnetic wave comprising at least two sinusoidal components, receiving the wave at the blast site and storing energy in the wave in the storage means;

enabling the switch means by changing the frequency of one of the components of the wave so that the switch means is actuatable from the remote site to connect the storage means to the fuse means;

actuating the switch means to connect the charged storage means to the fuse means by communicating by means of the wave a fire command signal to the detonator thereby to energize the fuse means to cause the charge to explode.

2. A method as claimed in claim 1 wherein the wave is transmitted in the form of a carrier modulated by a modulating signal.

3. A method as claimed in claim 2 wherein the carrier is amplitude modulated by the modulating signal.

4. A method as claimed in claim 2 comprising the steps of initially tuning a resonant circuit connected to the storage means to a first tuning frequency corresponding to a first frequency of the carrier of the wave, utilizing the wave with the carrier changing at the first carrier frequency to charge the storage means to a level where it is still insufficiently charged to energize the fuse means, utilizing frequency pulling in the resonant circuit to change the tuning frequency of the resonant circuit to a second frequency; changing at the control site the frequency of the carrier to the second frequency; and utilizing the wave with the carrier changing at the second frequency to charge the storage means to a level where it is sufficiently charged to energize the fuse means.

5. A method as claimed in claim 2 wherein, while charging the storage means, the carrier is modulated by a relatively low frequency modulating signal and wherein the frequency of the modulating signal is increased to a relatively higher frequency to enable the switch means.

6. A method as claimed in claim 5 wherein the relatively higher frequency modulating signal is utilized to arm enabling means in the detonator to change from a normally unarmed state to an armed state enabling the switch to be actuated.

7. A method as claimed in claim 1 comprising the step of waiting a predetermined delay time after reception of the fire command signal at the blast site before the storage means is connected to the fuse means.

8. A method as claimed in claim 7 wherein the predetermined delay time is determined by a RC time-constant in the detonator.

9. A method as claimed in claim 1 wherein the fire command signal is communicated by terminating transmission of the wave.

10. A remote controllable electronic detonator for an explosive charge comprising:

receiver means for wireless reception of an electromagnetic wave;

energy storage means connected to the receiver means, the storage means being chargeable by energy in the wave;

fuse means;

remote controllable switch means which, when enabled, is actuatable by a fire command signal carried by the wave to connect the energy storage means to the fuse means; and frequency dependent enabling means connected to the switch means for enabling the switch means;

the enabling means normally being in an unarmed state wherein the switch is not actuatable by the fire command signal and being adapted to be converted, by changing the frequency of a component of the wave, to an armed state wherein the switch means is actuatable by the fire command signal to connect the storage means to the fuse means to energize the fuse and to cause the charge to explode.

11. A detonator as claimed in claim 10 wherein the receiver means comprises a radio frequency resonant circuit tunable to the frequency of a radio frequency carrier.

12. A detonator as claimed in claim 11 comprising delay time means for effecting a predetermined delay after reception by the detonator of the said fire command signal and before the switch means connects the storage means to the fuse means.

13. A detonator as claimed in claim 11 wherein the energy storage means comprises a first capacitor arranged to be charged via the resonant circuit and wherein a first resistive decay path is provided for the capacitor to provide a first time constant.

14. A detonator as claimed in claim 12 wherein the energy storage means comprises a first capacitor arranged to be charged via the resonant circuit, wherein a first resistive decay path is provided for the first capacitor to provide a first time constant and wherein the delay time means comprises a second capacitor arranged to be charged via the resonant circuit and a second resistive decay path connected to the second capacitor to provide a second time constant, the first time constant being longer than the second time constant.

15. A detonator as claimed in claim 14 wherein the enabling means is armed by changing the frequency of the modulating signal.

16. A detonator as claimed i claim 15 wherein the enabling means is arranged such that when it is in the unarmed state it inhibits decay of charge on the second capacitor and when it is in the armed state it allows decay of the charge on the second capacitor thereby to actuate the switch means.

17. A detonator as claimed in claim 16 wherein the second capacitor is arranged such as to be charged to a voltage opposite to that on the first capacitor, wherein the second resistive decay path is arranged such that when the enabling means is armed the charge on the second capacitor can decay towards the voltage on the first capacitor, and wherein the switch means is arranged such that it connects the first capacitor to the fuse means when the decaying voltage on the second capacitor has reached a predetermined value.

18. A detonator as claimed in claim 15 whwerein the enabling means comprises a latching circuit having a control gate, the gate being connected to a third capacitor chargeable by the wave via a charge pump connected between the resonant circuit and the third capacitor, the enabling means being in the unarmed state while the voltage on the third capacitor is below a predetermined triggering voltage value for the latching circuit, the third capacitor having a capacitance such that and the third resistor a resistance such that, while the modulating signal has a frequency below a predetermined frequency, the charge on the third capacitor decays at a rate faster than the rate at which charge is fed to the third capacitor and when the frequency of the modulating signal is increased to the predetermined frequency value, charge builds up on the third capacitor until the voltage on the third capacitor exceeds said predetermined triggering voltage value thereby to trigger the latching circuit and to arm the enabling means.

19. A detonator as claimed in claim 18 wherein the latching circuit is a thyristor switch.

20. A detonator as claimed i claim 11 wherein the resonant circuit comprises at least one diode connected to a capacitor, said diode having a varicap effect on the resonant circuit thereby to vary the resonance frequency of the resonant circuit as a function of the charge stored in said capacitor.

* * * * *